US010167860B2

(12) United States Patent
Yamaoka

(10) Patent No.: US 10,167,860 B2
(45) Date of Patent: Jan. 1, 2019

(54) HERMETIC COMPRESSOR AND REFRIGERATION APPARATUS

(71) Applicant: Panasonic Intellectual Property Management Co., Ltd., Osaka-shi, Osaka (JP)

(72) Inventor: Masakazu Yamaoka, Shiga (JP)

(73) Assignee: PANASONIC APPLIANCES REFRIGERATION DEVICES SINGAPORE, Singapore (SG)

( * ) Notice: Subject to any disclaimer, the term of this patent is extended or adjusted under 35 U.S.C. 154(b) by 239 days.

(21) Appl. No.: 14/423,955

(22) PCT Filed: Dec. 13, 2013

(86) PCT No.: PCT/JP2013/007346
§ 371 (c)(1),
(2) Date: Feb. 25, 2015

(87) PCT Pub. No.: WO2014/091764
PCT Pub. Date: Jun. 19, 2014

(65) Prior Publication Data

US 2015/0219085 A1 Aug. 6, 2015

(30) Foreign Application Priority Data

Dec. 13, 2012 (JP) ..... 2012-271955

(51) Int. Cl.
*F04B 39/00* (2006.01)
*F04B 39/10* (2006.01)
(Continued)

(52) U.S. Cl.
CPC ..... *F04B 39/1066* (2013.01); *F04B 39/0055* (2013.01); *F04B 39/0061* (2013.01);
(Continued)

(58) Field of Classification Search
CPC ..... F04B 39/1066; F04B 39/0055; F04B 39/0061; F04B 39/023
(Continued)

(56) References Cited

U.S. PATENT DOCUMENTS 5,577,898 A * 11/1996 Lee ..... F04B 39/0072 181/403
5,613,842 A * 3/1997 Alfano ..... F04B 39/0072 181/403
(Continued)

FOREIGN PATENT DOCUMENTS

JP 2010-529342 8/2010
JP 2010-248912 11/2010
(Continued)

OTHER PUBLICATIONS

Office Action issued in corresponding Chinese patent application No. 201380044885.9, dated May 9, 2016, 11 pages with translation.

*Primary Examiner* — Christopher Bobish
(74) *Attorney, Agent, or Firm* — Hamre, Schumann, Mueller & Larson, P.C.

(57) ABSTRACT

A communication pipe outlet (263) of a suction muffler (26) included in a hermetic compressor (10) includes a communication opening (264). An upper shape (264*a*) of the communication opening (264) is a curved protruding shape, and a lower shape (264*b*) of the communication opening (264) is a rectangular shape. A suction hole (33) of a valve plate (30) included in the hermetic compressor (10) is formed such that the cylinder side of the suction hole (33) has a non-recessed closed-curve shape, and the communication pipe side of the suction hole (33) has a shape similar to that of the communication opening (264). The valve plate (30) and a communication pipe (262) are connected in a state where an upper peripheral surface of the communication
(Continued)

opening (264) of the communication pipe outlet (263) corresponds to an upper peripheral surface of the suction hole (33).

6 Claims, 12 Drawing Sheets

(51) Int. Cl.
*F25B 31/00* (2006.01)
*F04B 39/02* (2006.01)
*F04B 39/06* (2006.01)

(52) U.S. Cl.
CPC ..... *F04B 39/023* (2013.01); *F04B 39/06* (2013.01); *F04B 39/10* (2013.01); *F25B 31/00* (2013.01); *F25B 2500/12* (2013.01)

(58) Field of Classification Search
USPC ..... 3/902
See application file for complete search history.

(56) References Cited

U.S. PATENT DOCUMENTS 6,186,751 B1 * 2/2001 Rigo ..... F04B 39/0072 181/403
6,280,153 B1 * 8/2001 Iversen ..... F04C 29/12 138/37
6,305,912 B1 * 10/2001 Svendsen ..... F04B 39/0072 29/888.02
6,358,019 B1 3/2002 Iversen et al.
6,402,484 B1 * 6/2002 Svendsen ..... F04B 39/0072 29/888.05
6,524,080 B1 * 2/2003 Chintamani ..... F04B 39/0061 181/212
7,083,400 B2 * 8/2006 Possamai ..... F04B 39/0055 137/512
8,323,001 B2 * 12/2012 Kinjo ..... F04B 39/0055 181/232
2002/0017425 A1 * 2/2002 Yoon ..... F04B 39/0061 181/292
2010/0260621 A1 10/2010 Kinjo et al.

FOREIGN PATENT DOCUMENTS

JP 2012-107575 6/2012
WO WO 02/06672 1/2002
WO WO 2009/090856 7/2009
WO WO 2009090856 A2 * 7/2009 ..... F04B 39/0061

* cited by examiner

HERMETIC COMPRESSOR AND REFRIGERATION APPARATUS

TECHNICAL FIELD

The present invention relates to a hermetic compressor for use in a refrigeration cycle of, for example, a refrigeration apparatus or an air conditioner, and to a refrigeration apparatus using the hermetic compressor.

BACKGROUND ART

Hermetic compressors are widely used, for example, in refrigeration apparatuses such as refrigerator-freezers or in air conditioners. In recent years, there is a demand for such hermetic compressors to have high efficiency and high reliability so that power consumption can be reduced.

For example, Patent Literature 1 discloses a configuration in which part of a suction hole formed in a valve plate is curved for the purpose of realizing high efficiency and high reliability of a hermetic compressor. The valve plate is provided in a manner to close an end of a cylinder. The suction hole and a discharge hole are formed in the valve plate. A communication pipe of a suction muffler is connected to the suction hole. A cooling medium gas is sucked from the communication pipe into the cylinder through the suction hole.

The suction muffler is positioned below the cylinder. The communication pipe extends upward from the suction muffler below. If the direction in which the communication pipe extends is a longitudinal direction, the cylinder is provided in a manner to extend in a transverse direction. The valve plate is positioned at the end of the cylinder. The upper end of the communication pipe is provided with a communication pipe outlet, which is formed in a manner to extend in the transverse direction. The communication pipe outlet is connected to the suction hole of the valve plate, and thereby a suction passage is formed. Accordingly, a passage for the cooling medium gas, the passage extending from the communication pipe to the suction passage (the suction passage is formed by the communication pipe outlet and the suction hole), is curved from the longitudinal direction into the transverse direction at the upper end of the communication pipe.

As shown in FIG. 11, Patent Literature 1 discloses a valve plate 80, in which a suction hole 83 is formed in a substantially U shape. A transition portion T, which is curved, is formed between an opening at the cylinder side and an opening at the communication pipe side. The transition portion T is formed such that at least part of the internal profile of a suction passage 831 is curved, and thereby a duct portion is defined. The suction passage 831 facilitates smooth transition of the cooling medium gas from a communication pipe outlet 863 to the suction hole 83, making it possible to reduce the suction resistance of the cooling medium gas. When the suction resistance is reduced, the suction mass of the cooling medium gas per unit time (i.e., a cooling medium circulation amount) increases, and thereby the efficiency of the hermetic compressor is improved.

CITATION LIST

Patent Literature

PTL 1: (PCT) International Publication No. WO 02/06672

SUMMARY OF INVENTION

Technical Problem

However, the manufacturing of the valve plate 80 of the above-described hermetic compressor disclosed in Patent Literature 1 is not easy. In addition, as a result of studies conducted by the inventors of the present invention, they have found out the following problem: the valve plate 80 with the above-described configuration cannot effectively suppress an increase in the suction resistance in the vicinity of the suction hole 83.

Generally speaking, the valve plate is manufactured by molding a metal powder in a mold and sintering the powder (powder metallurgy). In the valve plate 80 with the above-described configuration, the suction hole 83 has a complex substantially U shape. Therefore, at the time of fabricating the mold, the forming process of the mold is complex. For this reason, the mold cannot be fabricated easily. Consequently, the valve plate 80 cannot be manufactured easily.

Generally speaking, the cross section of the communication pipe has a substantially round shape. However, in the valve plate 80 with the above-described configuration, the suction hole 83 has a substantially U shape. For this reason, as shown in FIG. 11, even though the transition portion T is formed in the suction passage 831, the cross-sectional shape of the passage suddenly changes from a substantially round shape (the communication pipe outlet 863) into a substantially U shape (the suction hole 83). Accordingly, the cooling medium gas from a passage having a large cross-sectional area (the communication pipe outlet 863) suddenly flows into a passage having a small cross-sectional area (the suction hole 83). As a result, the suction resistance of the cooling medium gas increases.

In general, the flow velocity of the cooling medium gas increases in the vicinity of the suction hole. However, since the suction hole 83 has a substantially U shape, a difference in the flow velocity of the cooling medium gas tends to occur between the central portion of the suction hole 83 and both end portions of the suction hole 83. Accordingly, in the suction hole 83 having the substantially U shape, a flow through the central portion and a flow through both the end portions, i.e., two kinds of flows, are formed. Consequently, the cooling medium gas cannot smoothly flow into the cylinder.

As described above, in the case of using the valve plate 80 with the above-described configuration, the suction resistance increases in the vicinity of the suction hole 83 due to the sudden change in the area of the passage and the formation of the two kinds of flows. Therefore, in a hermetic compressor including such a valve plate 80, suction loss is great, which lowers the compression efficiency.

The present invention has been made to solve the above-described problems. An object of the present invention is to make it possible to readily manufacture a valve plate and to provide a hermetic compressor with higher efficiency.

Solution to Problem

In order to solve the above-described problems, a hermetic compressor according to the present invention includes: a sealed container storing a lubricating oil; an electric element housed in the sealed container; and a compression element housed in the sealed container and driven by the electric element to compress a cooling medium. The compression element includes: a cylinder, which forms a compression chamber; a valve plate, which seals one end portion of the cylinder and in which a suction hole and a discharge hole are formed; a suction reed configured to open and close the suction hole; and a suction muffler, which is positioned below the cylinder and in which a silencing space is formed, the suction muffler including a communication pipe connected to the suction hole. The communication pipe extends upward from the suction muffler toward the one end portion of the cylinder, and an upper end of the communication pipe is provided with a communication pipe outlet, which is in communication with the suction hole. The communication pipe outlet includes a communication opening, whose upper shape is a curved protruding shape and whose lower shape is a rectangular shape. An opening of the suction hole at the cylinder side has a non-recessed closed-curve shape, and an opening of the suction hole at the communication pipe side has a shape similar to that of the communication opening of the communication pipe outlet. The valve plate and the communication pipe are connected in a state where an upper peripheral surface of the communication opening of the communication pipe outlet corresponds to an upper peripheral surface of the suction hole.

In the hermetic compressor with the above configuration, a lower peripheral surface of the suction hole may include a curved portion or a sloped portion, the curved portion being curved from the opening of the suction hole at the communication pipe side toward the opening of the suction hole at the cylinder side, the sloped portion being sloped from the opening of the suction hole at the communication pipe side toward the opening of the suction hole at the cylinder side.

The present invention further includes a refrigeration apparatus including a refrigeration cycle including the hermetic compressor configured in the above-described manner.

The above object, other objects, features, and advantages of the present invention will be made clear by the following detailed description of preferred embodiments with reference to the accompanying drawings.

Advantageous Effects of Invention

The above-described configuration according to the present invention provides an advantage of making it possible to readily manufacture the valve plate and provide a hermetic compressor with higher efficiency.

DESCRIPTION OF EMBODIMENTS

Figure 1:
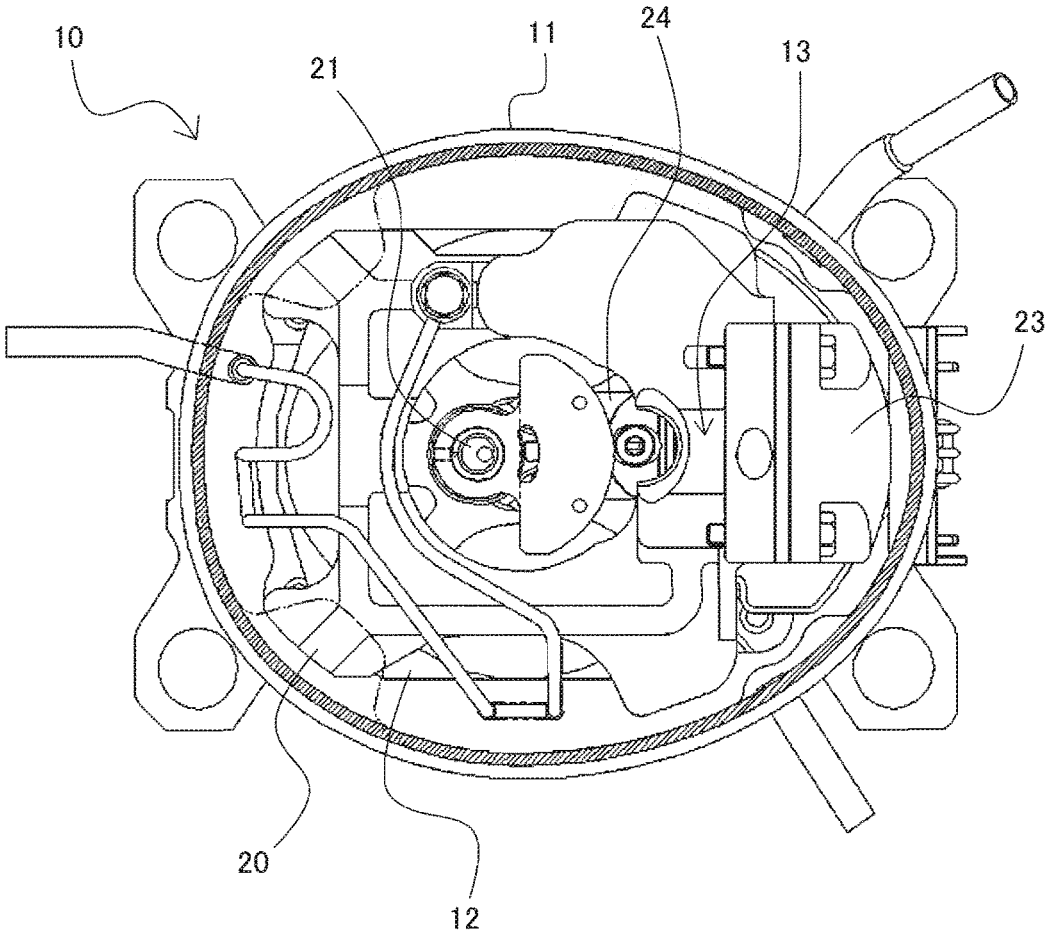
FIG. 1 is a cross-sectional view showing a typical configuration example of a hermetic compressor according to one embodiment of the present invention.

A hermetic compressor according to the present invention includes: a sealed container storing a lubricating oil; an electric element housed in the sealed container; and a compression element housed in the sealed container and driven by the electric element to compress a cooling medium. The compression element includes: a cylinder, which forms a compression chamber; a valve plate, which seals one end portion of the cylinder and in which a suction hole and a discharge hole are formed; a suction reed configured to open and close the suction hole; and a suction muffler, which is positioned below the cylinder and in which a silencing space is formed, the suction muffler including a communication pipe connected to the suction hole. The communication pipe extends upward from the suction muffler toward the one end portion of the cylinder, and an upper end of the communication pipe is provided with a communication pipe outlet, which is in communication with the suction hole. The communication pipe outlet includes a communication opening, whose upper shape is a curved protruding shape and whose lower shape is a rectangular shape. An opening of the suction hole at the cylinder side has a non-recessed closed-curve shape, and an opening of the suction hole at the communication pipe side has a shape similar to that of the communication opening of the communication pipe outlet. The valve plate and the communication pipe are connected in a state where an upper peripheral surface of the communication opening of the communication pipe outlet corresponds to an upper peripheral surface of the suction hole.

According to the above configuration, the suction hole formed in the valve plate does not have a complex shape. This makes it possible to readily fabricate a mold for use in manufacturing the valve plate. Therefore, the valve plate can be readily manufactured at an inexpensive cost.

Further, according to the above configuration, the fundamental shape of the suction hole (the shape of the opening at the cylinder side) is different from the shape of the opening at the communication pipe side. For this reason, the suction hole can rectify the flow of a cooling medium gas. Therefore, it is less likely that a difference in the flow velocity of the cooling medium gas occurs inside the suction hole. Accordingly, the cooling medium gas is smoothly introduced from the communication pipe into the cylinder through a suction passage, and thereby the suction resistance of the cooling medium gas can be reduced effectively. This makes it possible to increase the suction mass of the cooling medium gas per unit time (i.e., a cooling medium circulation amount). As a result, the highly efficient hermetic compressor can be provided.

In the hermetic compressor with the above configuration, a lower peripheral surface of the suction hole may include a curved portion or a sloped portion, the curved portion being curved from the opening of the suction hole at the communication pipe side toward the opening of the suction hole at the cylinder side, the sloped portion being sloped from the opening of the suction hole at the communication pipe side toward the opening of the suction hole at the cylinder side.

According to the above configuration, owing to the curved portion or the sloped portion of the suction hole, the cooling medium gas smoothly flows from the communication pipe outlet into the suction hole. Accordingly, the suction resistance of the cooling medium gas in the vicinity of the suction hole can be reduced effectively, and also, the flow of the cooling medium gas toward the suction hole is further facilitated. As a result, the hermetic compressor with higher efficiency can be provided.

In the hermetic compressor with the above configuration, the suction hole may be formed such that its cross-sectional area gradually decreases from the opening of the suction hole at the communication pipe side toward the opening of the suction hole at the cylinder side.

The above configuration makes it possible to improve the cooling medium gas rectifying function of the suction hole, and increase the flow velocity of the cooling medium gas. Accordingly, the flow of the cooling medium gas from the suction hole into the cylinder is further facilitated, and the suction reed opens more promptly. In addition, the cross-sectional area of the opening of the suction hole at the cylinder side is less than the cross-sectional area of the opening of the suction hole at the communication pipe side. Accordingly, a stress occurring to a portion of the suction reed, the portion being in contact with the suction hole, during compression can also be suppressed. This makes it possible to improve the reliability of the suction reed. As a result, the hermetic compressor with higher reliability can be provided.

In the hermetic compressor with the above configuration, the opening of the suction hole at the cylinder side may have a round shape or an elliptical shape, and an upper portion of the communication opening of the communication pipe outlet may have a half-round shape or a semi-elliptical shape.

According to the above configuration, the fundamental shape of the suction hole is round or elliptical. Therefore, at the time of fabricating the mold, the forming process of the mold is easy, and thus the fabrication of the mold is easier compared to the case of a conventional valve plate whose suction hole is substantially U-shaped.

If the fundamental shape of the suction hole is round or elliptical, and the upper shape of the communication opening is half-round or semi-elliptical, then the fundamental cross-sectional shape of the suction passage can be made substantially round or substantially elliptical. This makes it possible to obtain favorable flowability of the cooling medium gas in the suction passage. As a result, the hermetic compressor with higher reliability can be provided.

A refrigeration apparatus according to the present invention includes a refrigeration cycle including the hermetic compressor configured in the above-described manner.

According to the above configuration, since the refrigeration apparatus includes the refrigeration cycle including the highly efficient hermetic compressor, the refrigeration apparatus is capable of efficient cooling operation. As a result, the refrigeration apparatus with reduced power consumption (amount) can be provided.

Hereinafter, preferred embodiments of the present invention are described with reference to the drawings. In the drawings, the same or corresponding elements are denoted by the same reference signs, and repeating the same descriptions is avoided below.

Embodiment 1

[Hermetic Compressor]

Figure 2:
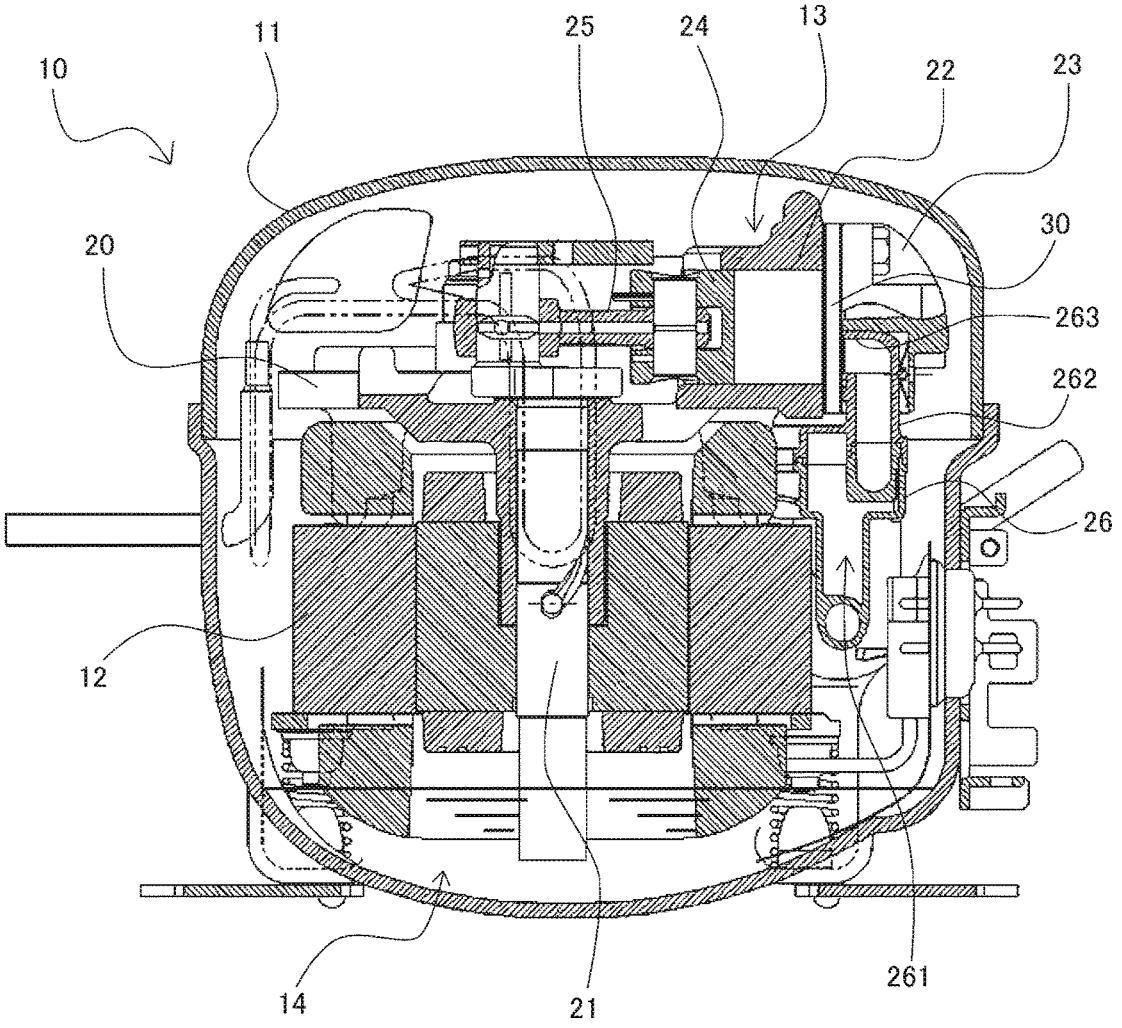
FIG. 2 is a longitudinal sectional view of the hermetic compressor shown in FIG. 1.

First, one example of a specific configuration of a hermetic compressor according to Embodiment 1 is described with reference to FIG. 1 to FIG. 4. As shown in FIG. 1 and FIG. 2, a hermetic compressor 10 according to the present embodiment includes a sealed container 11, an electric element 12, and a compression element 13. As shown in FIG. 2, a lubricating oil 14 is stored inside the sealed container 11. In addition, the sealed container 11 houses the electric element 12 and the compression element 13.

The electric element 12 is constituted by a stator and a rotor, and drives the compression element 13. The stator is disposed around the outer periphery of the rotor, such that a gap is formed between the stator and the rotor. The rotor fixes a shaft 21, which is a fixed shaft. The rotor is configured to be rotatable together with the shaft 21 in a state of being fitted in the stator.

The compression element 13 is driven by the electric element 12, and compresses a cooling medium gas. In the present embodiment, the compression element 13 includes a block 20, the shaft 21, a cylinder 22, a cylinder head 23, a piston 24, a connecting rod 25, a suction muffler 26, a valve plate 30, and other components such as a suction reed and a discharge reed not shown in FIG. 1 and FIG. 2.

The shaft 21 is provided in the sealed container 11 such that the central axis of the shaft 21 extends in the vertical direction (longitudinal direction). The shaft 21 includes a main shaft, an eccentric shaft, a feed oil pump, etc. The main shaft is press-fitted to the rotor of the electric element 12. The eccentric shaft is formed to be eccentric relative to the main shaft. The feed oil pump is provided on the eccentric shaft, which is the lower end of the shaft 21. The feed oil pump is partly immersed in the stored lubricating oil 14 so as to be able to feed the lubricating oil 14.

The block 20 includes the cylinder 22 with a bore, a bearing unit, etc. The cylinder 22 is disposed in the sealed container 11 in a manner to extend in a transverse direction (horizontal direction), and is fixed to the bearing unit. The bore is formed as a substantially cylindrical recess, whose diameter is substantially the same as the diameter of the piston 24. The piston 24 is inserted inside the bore such that the piston 24 can make sliding motion in a reciprocating manner. The cylinder 22 (the inside of the bore) and the piston 24 form a compression chamber. Inside the compression chamber, the cooling medium gas is compressed. The bearing unit is fixed to the block 20, and the shaft 21 is rotatably inserted in the bearing unit.

The piston 24 inserted in the bore of the cylinder 22 is connected to the connecting rod 25. The connecting rod 25 serves to connect between the piston 24 and the shaft 21, and is connected to the eccentric shaft of the shaft 21. The piston 24 is inserted in one end of the bore, and the other end of the bore is sealed by the valve plate 30.

The valve plate 30 is positioned between the cylinder 22 and the cylinder head 23. Accordingly, one surface of the valve plate 30 (a cylinder-side surface) seals one end portion of the cylinder 22, and the cylinder head 23 is fixed to the other surface of the valve plate 30 (a communication pipe-side surface). The cylinder head 23 is in communication with the compression chamber, and a discharge space is formed inside the cylinder head 23. The suction muffler 26 is, when seen from the cylinder 22 and the cylinder head 23, positioned below them in the sealed container 11. For example, the suction muffler 26 is made of a resin such as polybutylene terephthalate (PBT). The suction muffler 26 includes a suction port, which is not shown. Inside the suction muffler 26, a silencing space 261 is formed. The upper part of the suction muffler 26 is provided with a communication pipe 262.

Figure 3:
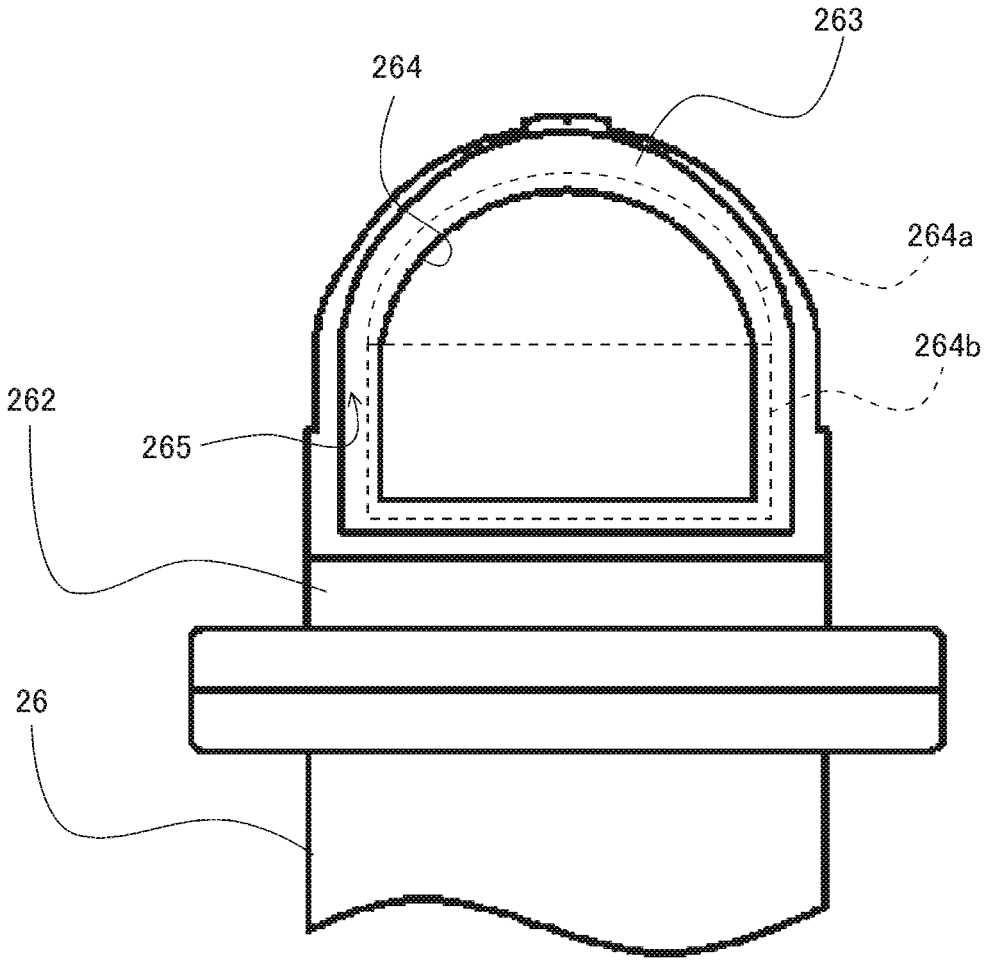
FIG. 3 is a schematic front view showing an example of a configuration in the vicinity of a communication pipe of a suction muffler used in the hermetic compressor shown in FIG. 1.

The communication pipe 262 extends upward toward the one end portion of the cylinder 22. As shown in FIG. 3, the upper end of the communication pipe 262 is provided with a communication pipe outlet 263. The communication pipe outlet 263 includes a communication opening 264. An upper shape 264*a* of the communication opening 264 is a curved protruding shape. A lower shape 264*b* of the communication opening 264 is a rectangular shape. In the example shown in FIG. 3, the upper shape 264*a* is substantially half-round, and the lower shape 264*b* is horizontally long and substantially rectangular. It should be noted that the upper shape 264*a* may be semi-elliptical, or may be a different curved shape, such as parabolic. Also, the lower shape 264*b* may be square. As shown in FIG. 2, the communication pipe 262 is provided such that the communication pipe 262 is held between the cylinder head 23 and the valve plate 30.

Figure 4:
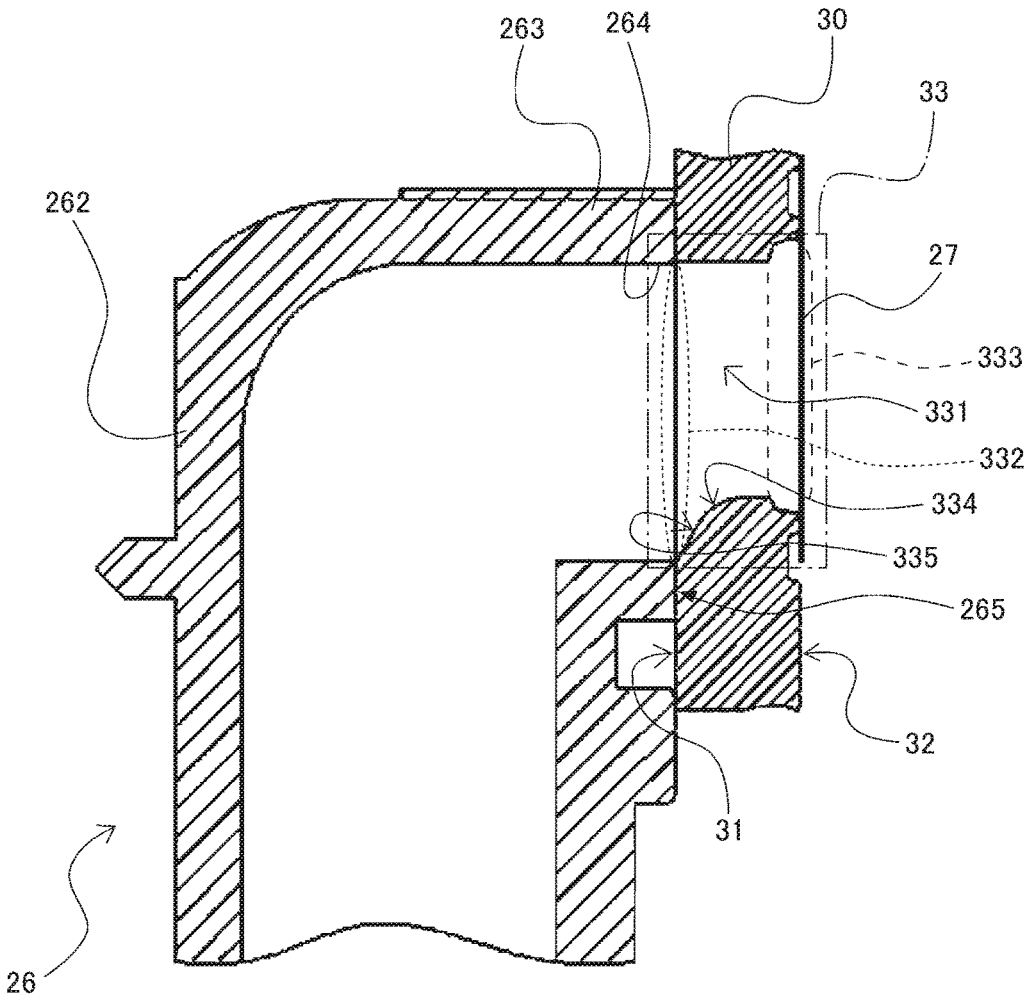
FIG. 4 is a schematic sectional view showing an example of a configuration in the vicinity of the communication pipe of the suction muffler and a suction hole of a valve plate shown in FIG. 3.

As shown in FIG. 3, the communication opening 264 of the communication pipe outlet 263 is surrounded by a flat end face 265. As shown in FIG. 4, the end face 265 is in contact with a communication pipe-side surface 31 (the aforementioned other surface) of the valve plate 30.

For example, the valve plate 30 is made of a metal, such as a metal sintered body (sintered metal). A suction hole 33 shown in FIG. 4 (a hole indicated by a one-dot chain line in FIG. 4) and a discharge hole not shown in FIG. 4 are formed in the valve plate 30. A suction reed 27 is provided on a cylinder-side surface 32 (the aforementioned one surface) of the valve plate 30 in such a manner as to cover the suction hole 33. The suction reed 27 opens and closes the suction hole 33. The discharge hole, not shown, is opened and closed by a discharge reed, which is not shown. The communication pipe outlet 263 is connected to the suction hole 33 of the valve plate 30 via a gasket (or a different known sealing member), which is not shown. It should be noted that a specific configuration of the valve plate 30 will be described below.

Hereinafter, operations of the hermetic compressor 10 with the above-described configuration are described. First, electric power from a commercial power supply, which is not shown, is supplied to the electric element 12, and thereby the rotor of the electric element 12 is caused to rotate. Since the rotor causes the shaft 21 to rotate, the eccentric shaft also rotates in accordance with the rotation of the main shaft. The eccentric motion of the eccentric shaft relative to the main shaft is transmitted from the connecting rod 25 to the piston 24. As a result, the piston 24 slidingly moves inside the bore of the cylinder 22 in a reciprocating manner.

Owing to the reciprocating sliding motion of the piston 24, the cooling medium gas is introduced into the sealed container 11 from a refrigeration cycle (cooling circuit, cooling medium circuit), which is not shown, and is released in the sealed container 11. The released cooling medium gas is sucked into the suction muffler 26 through a suction opening. The sucked cooling medium gas is released in the silencing space 261, and thereafter intermittently sucked into the compression chamber (an isolated space formed by the cylinder 22 and the piston 24) from the communication pipe 262 through the suction hole 33 of the valve plate 30. The cooling medium gas sucked into the compression chamber is compressed in the compression chamber, and is discharged to the discharge space of the cylinder head 23 through the discharge hole of the valve plate 30. The cooling medium gas discharged to the discharge space is discharged to the refrigeration cycle, which is not shown. Then, the cooling medium gas circulates in the refrigeration cycle, and is led into the sealed container 11 again.

[Valve Plate]

Next, a specific configuration of the valve plate 30 is described in detail with reference to FIG. 4 and FIGS. 5 to 7.

Figure 5:
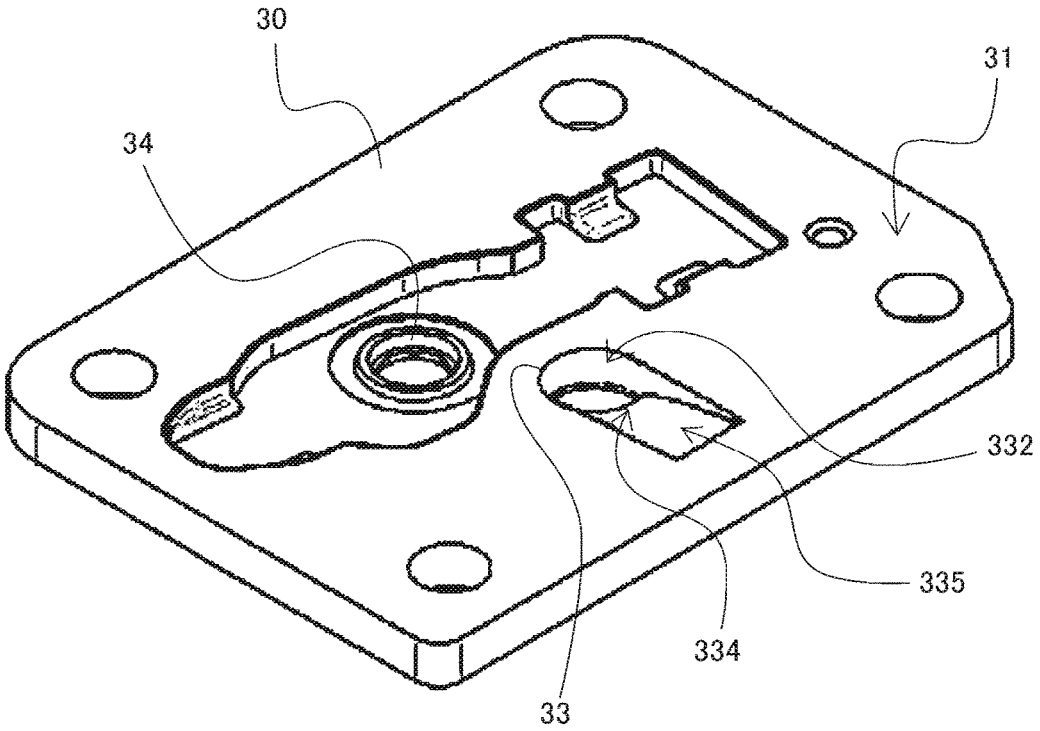
FIG. 5 is a perspective view seen from the communication pipe side, the view showing a configuration example of the valve plate, which is used in the hermetic compressor of FIG. 1 and which is partly shown in FIG. 4.
Figure 6:
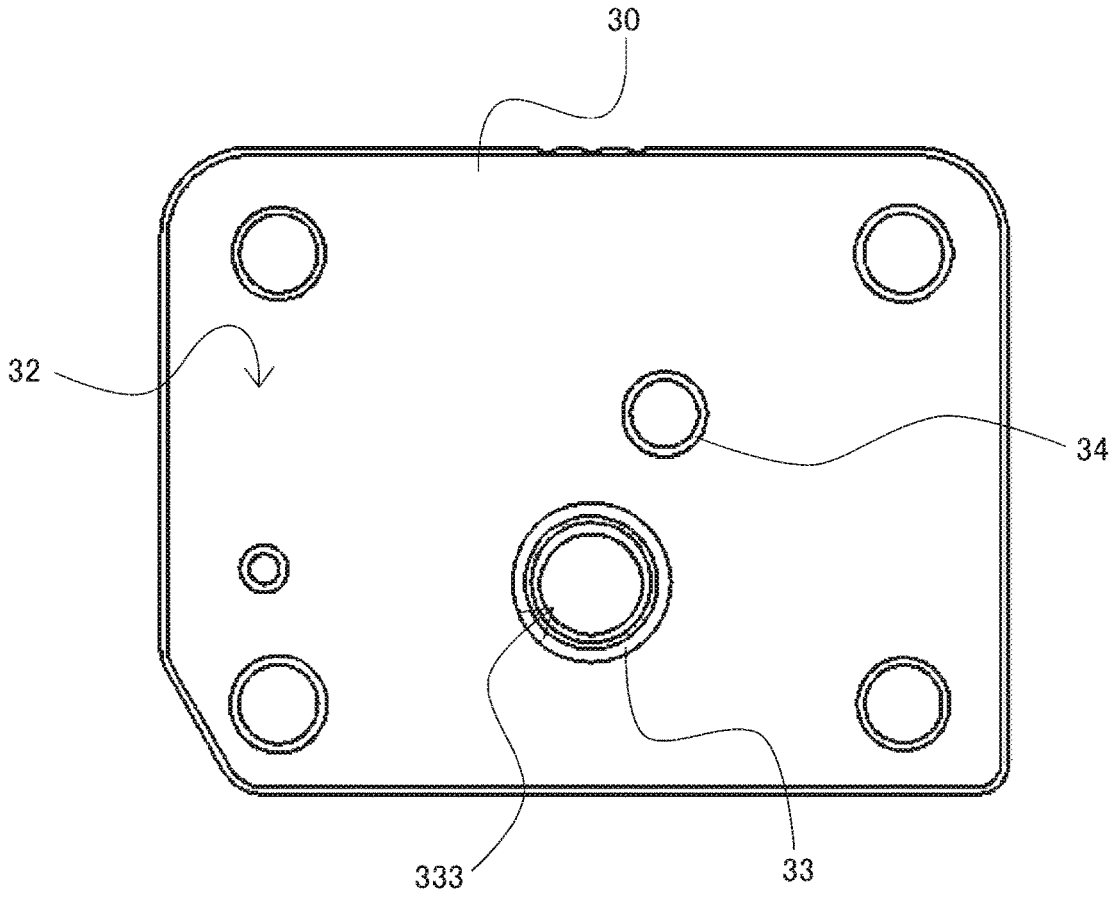
FIG. 6 is a front view seen from the cylinder side, the view showing the valve plate of FIG. 5.

As previously described, as shown in FIG. 5 and FIG. 6, the suction hole 33 and discharge hole 34 are formed in the valve plate 30. FIG. 5 is a perspective view of the valve plate 30 seen from the communication pipe-side surface 31. FIG. 6 is a perspective view of the valve plate 30 seen from the cylinder-side surface 32.

As shown in FIG. 4 and FIG. 5, the opening of the suction hole 33 at the communication pipe 262 side (i.e., the opposite side to the cylinder 22) is a suction inlet-side opening 332 (in FIG. 4, an opening indicated by a dotted line). As shown in FIG. 4 and FIG. 6, the opening of the suction hole 33 at the cylinder 22 side is a suction outlet-side opening 333 (in FIG. 4, indicated by a dashed line). The communication pipe outlet 263 is, when seen from the body of the communication pipe 262 extending in the longitudinal direction, formed to extend in the transverse direction. The communication pipe outlet 263 is connected to the suction inlet-side opening 332 of the suction hole 33. It should be noted that, as shown in FIG. 4, the communication pipe outlet 263 and the suction hole 33 form a suction passage 331, through which the cooling medium gas flows.

The suction outlet-side opening 333 (opening at the cylinder side) of the suction hole 33 has a non-recessed closed-curve shape. The specific shape of the closed curve is not particularly limited. However, in general, the shape of the closed curve may be round or elliptical. In the present embodiment, as shown in FIG. 6, the suction outlet-side opening 333 has a substantially round shape, whereas the suction inlet-side opening 332 (opening at the communication pipe side) of the suction hole 33 has a shape similar to that of the communication opening 264. In the present embodiment, the upper shape 264*a* of the communication opening 264 is substantially half-round, and the lower shape 264*b* of the communication opening 264 is horizontally long and substantially rectangular. Accordingly, the upper portion of the suction inlet-side opening 332 is substantially half-round, and the lower portion of the suction inlet-side opening 332 is rectangular. Although in the present embodiment the suction inlet-side opening 332 has the same size as that of the communication opening 264, the size of the suction inlet-side opening 332 may be slightly smaller than that of the communication opening 264.

Figure 7:
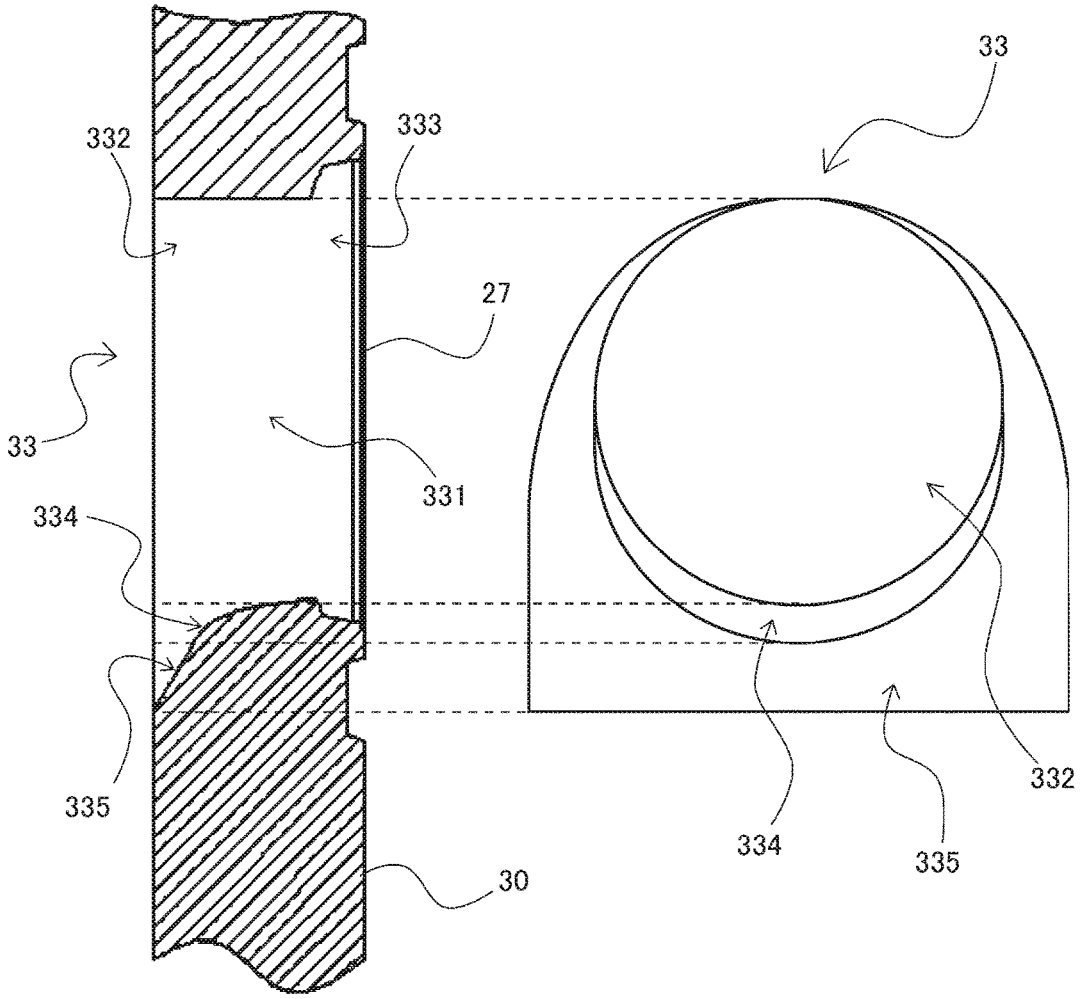
FIG. 7 illustrates sectional and front views showing a configuration example of the suction hole formed in the valve plate shown in FIG. 5 and FIG. 6, the views being schematically compared with each other.

As shown in FIG. 4, in a state where the valve plate 30 and the communication pipe 262 are connected, the upper peripheral surface of the communication opening 264 corresponds to the upper peripheral surface of the suction hole 33. Particularly in the present embodiment, the upper peripheral surface of the communication opening 264 and the upper peripheral surface of the suction hole 33 form one surface, such that there is substantially no step between these upper peripheral surfaces. On the other hand, the lower peripheral surface of the communication opening 264 is positioned below the lower peripheral surface of the suction outlet-side opening 333 of the suction hole 33. As shown in FIG. 4, FIG. 5, and FIG. 7, the lower peripheral surface of the suction hole 33 includes a curved portion 334 and a sloped portion 335. The sloped portion 335 and the curved portion 334 allow the lower peripheral surface of the communication opening 264 and the lower peripheral surface of the suction hole 33 to form a substantially continuous surface.

The curved portion 334 is a curved surface, which is curved from the suction inlet-side opening 332 toward the suction outlet-side opening 333. The sloped portion 335 is a sloped surface, which is sloped from the suction inlet-side opening 332 toward the suction outlet-side opening 333. In the present embodiment, as shown in FIG. 4 and FIG. 7, the sloped portion 335 is positioned at the communication pipe 262 side, and the curved portion 334 is positioned at the cylinder 22 side. The sloped portion 335 is a sloped surface, which is steeply sloped upward when seen from the suction inlet-side opening 332. The curved portion 334 is a surface continuous with the sloped portion 335, and is a curved surface slightly raised upward relative to the lower peripheral surface of the suction outlet-side opening 333. Accordingly, as shown in FIG. 7, when the suction hole 33 is seen in the direction of the cylinder 22 from the communication pipe 262 side, the sloped portion 335 is positioned at the front side, and the curved portion 334 is positioned at the back side.

The specific configurations of the curved portion 334 and the sloped portion 335 are not particularly limited. For example, the degree to which the curved portion 334 is curved may be suitably set in accordance with various conditions, such as the diameter of the suction hole 33, a relationship between the cross-sectional area of the suction inlet-side opening 332 and the cross-sectional area of the suction outlet-side opening 333, the thickness of the valve plate 30 (i.e., the length of the suction hole 33 in a direction in which the suction hole 33 extends), and the compression performance of the hermetic compressor 10. The specific slope angle of the sloped portion 335 is also not particularly limited. In general, however, the slope angle may be in the range of 35° to 55°, or more preferably in the range of 45°±5°, relative to the central axis of the suction hole 33 (in particular, the suction outlet-side opening 333).

Figure 8:
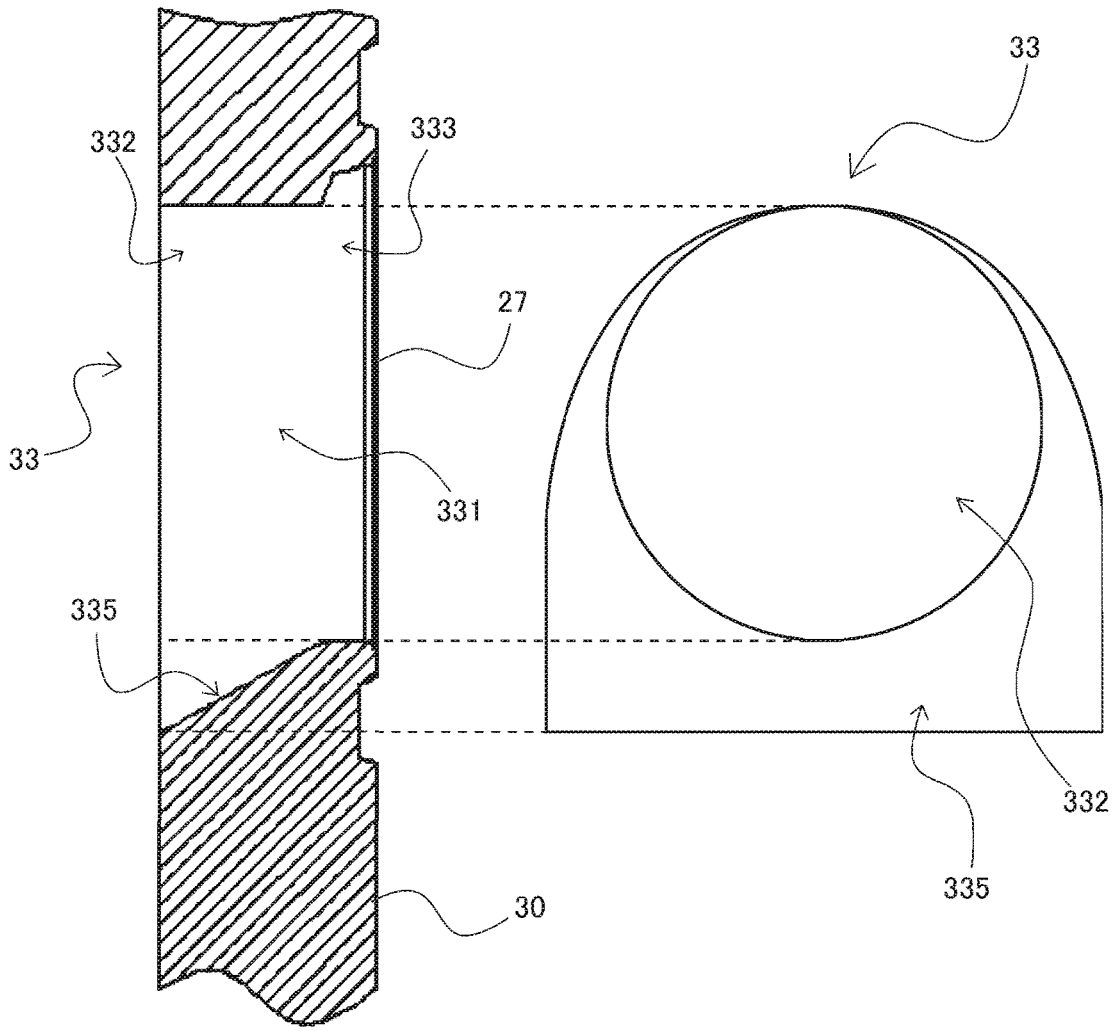
FIG. 8 illustrates sectional and front views showing another configuration example of the suction hole formed in the valve plate shown in FIG. 5 and FIG. 6, the views being schematically compared with each other.
Figure 9:
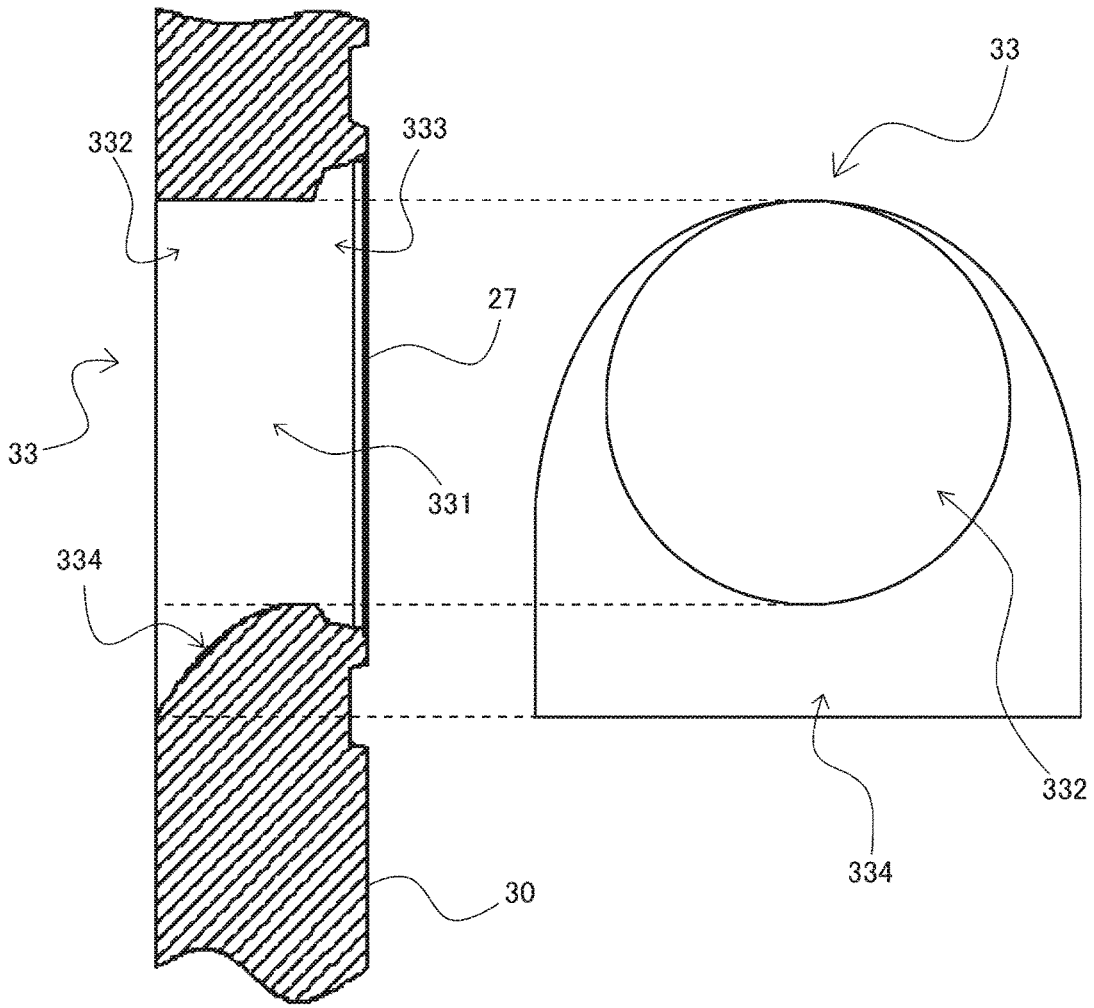
FIG. 9 illustrates sectional and front views showing yet another configuration example of the suction hole formed in the valve plate shown in FIG. 5 and FIG. 6, the views being schematically compared with each other.

It should be noted that, in the present invention, the shape of the lower peripheral surface of the suction hole 33 is not limited to the one including both the curved portion 334 and the sloped portion 335 as shown in FIG. 4, FIG. 5, and FIG. 7. As an alternative example, as shown in FIG. 8, the lower peripheral surface of the suction hole 33 may only include the sloped portion 335. As another alternative example, as shown in FIG. 9, the lower peripheral surface of the suction hole 33 may only include the curved portion 334. As yet another alternative example, which is not shown, the lower peripheral surface of the suction hole 33 may include other surfaces different from the curved portion 334 and the sloped portion 335, for example, a flat surface extending in the direction in which the suction hole 33 extends, or may include other components.

In the present invention, the shape of the suction inlet-side opening 332 of the suction hole 33 is similar to the shape of the communication opening 264. However, any shape that makes it possible to effectively reduce the suction resistance of the cooling medium gas may be adopted as the shape of the suction hole 33, so long as the valve plate 30 and the communication pipe 262 are connected such that the upper peripheral surface of the communication opening 264 of the communication pipe outlet 263 corresponds to the upper peripheral surface of the suction hole 33.

As described above, in the valve plate 30 according to the present embodiment, the fundamental shape of the suction hole 33 is a non-recessed closed-curve shape, such as a round shape or an elliptical shape. Therefore, at the time of fabricating a mold for use in manufacturing the valve plate 30, it is not necessary to form the mold into a complex shape, and thereby the complexity of the fabrication of the mold can be avoided. Therefore, the valve plate 30 can also be readily manufactured, and an increase in the manufacturing cost can be avoided or suppressed.

As previously described, the shape of the suction outlet-side opening 333 (opening at the cylinder side) of the suction hole 33 is a closed curve. The shape of the suction inlet-side opening 332 (opening at the communication pipe side) is similar to the shape of the communication opening 264 of the communication pipe outlet 263. The communication opening 264 is formed such that the upper shape **264*a* is a curved protruding shape, and the lower shape 264*b*** is a rectangular shape.

When the cooling medium gas is sucked from the communication pipe outlet 263 into the suction hole 33, the flow of the cooling medium gas is fast. However, unlike the conventional substantially U-shaped suction hole 83, since the suction hole 33 is configured in the above-described manner, it is less likely that a difference in the flow velocity of the cooling medium gas occurs between the central portion of the suction hole 33 and both end portions of the suction hole 33. This makes it possible to suppress stagnation of the cooling medium gas at the connection between the communication pipe outlet 263 and the suction hole 33, and allow the cooling medium gas to flow smoothly from the communication pipe 262 into the cylinder 22. As a result, an increase in the suction resistance of the cooling medium gas in the vicinity of the suction hole 33 (as well as an increase in the suction loss caused by the increase in the suction resistance) can be suppressed effectively.

In addition, in the present embodiment, the lower peripheral surface of the suction hole 33 includes one or both of the following portions: the curved portion 334, which is curved from the suction inlet-side opening 332 (opening at the communication pipe side) toward the suction outlet-side opening 333 (opening at the cylinder side); and the sloped portion 335, which is sloped from the suction inlet-side opening 332 (opening at the communication pipe side) toward the suction outlet-side opening 333 (opening at the cylinder side).

The suction passage 331 formed by the communication pipe outlet 263 and the suction hole 33 extends in the direction (the transverse direction, i.e., the horizontal direction) perpendicular to (or crossing) the direction (the longitudinal direction, i.e., the vertical direction) in which the communication pipe 262 extends. That is, the cooling medium gas linearly flowing from the suction muffler 26 through the communication pipe 262 flows in a curved direction (through the suction passage 331) at the upper end of the communication pipe 262 (i.e., at the communication pipe outlet 263). In this case, the flow velocity of the cooling medium gas is relatively high in the vicinity of the upper peripheral surface of the suction passage 331, whereas the flow velocity of the cooling medium gas is relatively low in the vicinity of the lower peripheral surface of the suction passage 331 since the cooling medium gas tends to stagnate in the vicinity of the lower peripheral surface.

However, if the lower peripheral surface of the suction hole 33 includes at least one of the curved portion 334 and the sloped portion 335, the cooling medium gas is led toward the cylinder 22 along the curved portion 334 and/or the sloped portion 335. As a result, the stagnation of the cooling medium gas in the vicinity of the lower peripheral surface is suppressed favorably, and the reduction of the flow velocity is suppressed. This makes it possible to facilitate the flow of the cooling medium gas through the entire suction passage 331. Consequently, an increase in the suction resistance of the cooling medium gas as well as an increase in the suction loss can be suppressed effectively.

As described above, the valve plate 30 with the above-described configuration makes it possible to reduce the suction resistance of the cooling medium gas as well as the suction loss. This makes it possible to increase the suction mass of the cooling medium gas per unit time (i.e., the cooling medium circulation amount). As a result, the hermetic compressor 10 with improved efficiency can be provided.

[Cross-Sectional Area of Suction Hole]

In the present embodiment, the suction hole 33 is formed such that the cross-sectional area of the suction inlet-side opening 332 is greater than the cross-sectional area of the suction outlet-side opening 333. That is, the suction hole 33 is formed such that its cross-sectional area gradually decreases (i.e., the suction hole 33 gradually becomes narrower) from the suction inlet-side opening 332 (opening at the communication pipe side) toward the suction outlet-side opening 333 (opening at the cylinder side). In this respect, a specific description is given with reference to FIG. 4 and FIG. 11 in comparison with the conventional configuration disclosed in Patent Literature 1.

Figure 11:
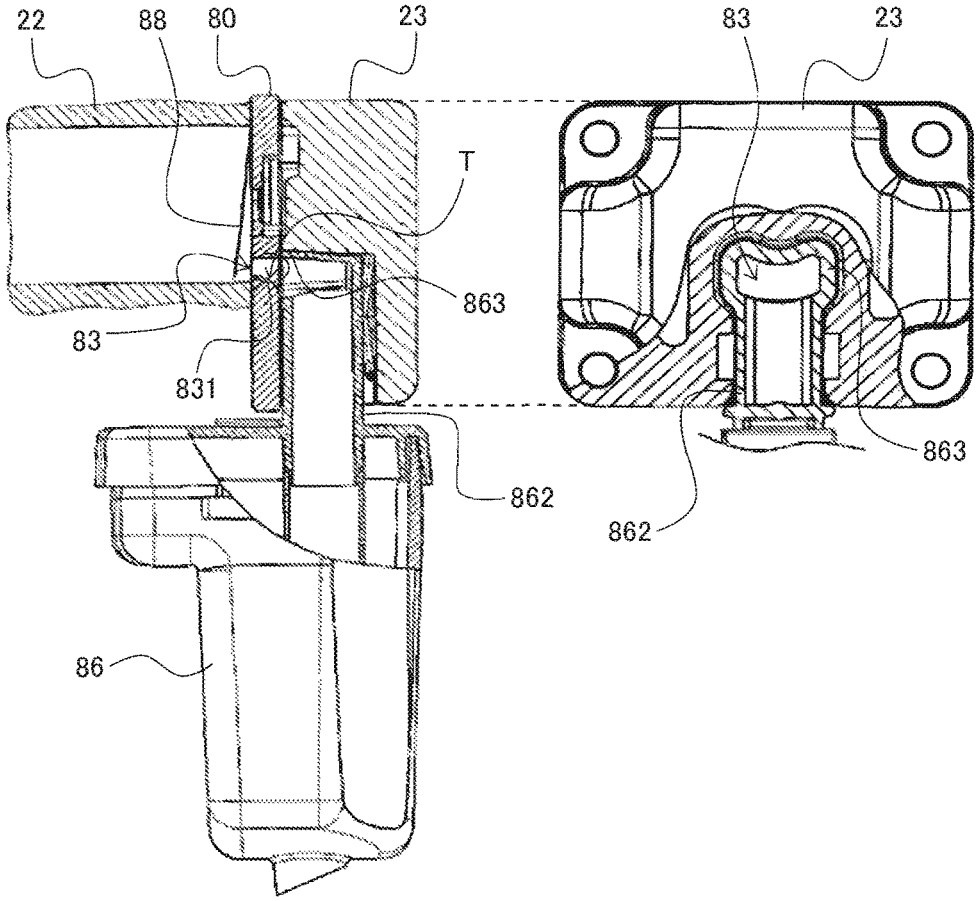
FIG. 11 illustrates sectional and front views showing a configuration in the vicinity of a valve plate in a conventional hermetic compressor, the views being schematically compared with each other.

As shown in FIG. 11, similar to the present embodiment, the conventional valve plate 80 is positioned between the cylinder 22 and the cylinder head 23, and the suction hole 83 is connected to the communication pipe outlet 863 of the communication pipe 862. It should be noted that FIG. 11 also shows a suction valve vane 88 (corresponding to the suction reed 27 of the present embodiment) in the cylinder 22.

Since the suction hole 83 is substantially U-shaped, the manufacturing of the conventional valve plate 80 is not easy. Even though the transition portion T is formed in the conventional valve plate 80, the cross-sectional shape of the passage suddenly changes from a substantially round shape (the communication pipe outlet 863) into a substantially U shape (the suction hole 83). Accordingly, when the cooling medium gas flows from the suction hole 83 into the cylinder 22, the suction resistance of the cooling medium gas increases.

In this respect, as a conceivable configuration for avoiding the increase in the suction resistance, the cross-sectional shape of the passage from the communication pipe 862 to the suction hole 83 (including the suction passage 831) may be formed in a substantially round shape. However, with such a configuration, both the amount of cooling medium gas sucked into the cylinder 22 and a stress occurring to the suction valve vane 88 (corresponding to the suction reed 27) during a compression operation cannot be made optimal.

At the time of compressing the cooling medium gas in the cylinder 22, a stress in a circumferential direction occurs to a portion of the suction valve vane 88 (corresponding to the suction reed 27), the portion being in contact with the suction hole 83. The stress occurring to the suction valve vane 88 during the compression can be reduced by making the diameter of the suction hole 83 relatively small. In this case, however, since the suction hole 83 is made small, the amount of cooling medium gas sucked into the cylinder 22 becomes small, causing a reduction in the compression efficiency. Meanwhile, the amount of cooling medium gas sucked into the cylinder 22 can be increased by making the diameter of the suction hole 83 relatively large. In this case, however, the stress occurring to the suction valve vane 88 during the compression increases, which may result in breakage of the suction valve vane 88.

On the other hand, in the present embodiment, as previously described, the shape of the suction hole 33 is fundamentally round or elliptical, and the shape of the suction hole 33 at the communication pipe 262 side is similar to the shape of the communication opening 264. In addition, the cross-sectional area of the suction hole 33 gradually decreases toward the cylinder 22. This configuration makes it possible to add impetus to the flow of the cooling medium gas. Accordingly, the flow of the cooling medium gas to the suction hole 33 can be further facilitated, and a suitable amount of cooling medium gas can be introduced into the cylinder 22. Moreover, since the cross-sectional area of the suction hole 33 at the cylinder 22 side (i.e., the size of the suction outlet-side opening 333) is relatively small, the stress occurring to the suction reed 27 during the compression can be reduced effectively. Furthermore, since the flow of the cooling medium gas is facilitated, the suction reed 27 can be caused to open promptly, which makes it possible to further reduce the suction resistance of the cooling medium gas. Therefore, the hermetic compressor 10 with further improved efficiency can be provided.

In the present embodiment, the cross-sectional area of the suction inlet-side opening 332 is preferably in the range of 150 to 250% of the cross-sectional area of the suction outlet-side opening 333, and more preferably in the range of 160 to 200% of the cross-sectional area of the suction outlet-side opening 333 although the relationship between the cross-sectional area of the suction inlet-side opening 332 and the cross-sectional area of the suction outlet-side opening 333 is not particularly limited. When the relationship between the cross-sectional areas of these openings is in the aforementioned range, a change in the cross-sectional area of the suction passage 331 can be made optimal. Accordingly, when the cooling medium gas flows from the communication pipe outlet 263 into the suction hole 33, an increase in the suction resistance can be suppressed while sufficiently securing the effective area of the suction hole 33. This consequently makes it possible to increase the suction mass of the cooling medium gas per unit time (i.e., the cooling medium circulation amount), and improve the efficiency of the hermetic compressor 10.

If the cross-sectional area of the suction inlet-side opening 332 is less than 150% of the cross-sectional area of the suction outlet-side opening 333, the suction loss significantly increases when the circulation amount of the cooling medium gas becomes great. On the other hand, if the cross-sectional area of the suction inlet-side opening 332 exceeds 250% of the cross-sectional area of the suction outlet-side opening 333, the suction loss significantly increases when the circulation amount of the cooling medium gas becomes small. Therefore, if the cross-sectional area of the suction inlet-side opening 332 is out of the aforementioned range relative to the cross-sectional area of the suction outlet-side opening 333, the efficiency of the hermetic compressor 10 is lowered.

As described above, the hermetic compressor according to the present invention stores the lubricating oil in the sealed container, and the sealed container houses: the electric element; and the compression element driven by the electric element to compress the cooling medium gas. The compression element includes: the cylinder, which forms the compression chamber; the valve plate, which seals one end portion of the cylinder and in which the suction hole and the discharge hole are formed; the suction reed configured to open and close the suction hole; the suction muffler, in which the silencing space is formed and which includes the communication pipe; and the cylinder head. The communication pipe includes the communication pipe outlet, which is formed to extend in the horizontal direction relative to the central axis of the suction hole and which is in communication with the suction hole. The communication pipe outlet is formed to have a shape that is a combination of a half-round shape and a substantially quadrangular shape protruding vertically downward relative to the central axis of the suction hole. The suction hole in the valve plate has a round shape. The shape of a suction inlet (suction-side opening) formed in the valve plate is similar to the shape of the communication pipe outlet.

Further, the suction passage, which leads the cooling medium gas from an end face of the communication pipe outlet toward the suction hole, is formed in the hermetic compressor according to the present invention. The suction passage preferably includes the curved portion or the sloped portion, which are formed from an end face of the suction inlet of the valve plate toward the suction hole.

With the above configuration, the cooling medium gas is rectified via the suction passage and introduced into the cylinder. Therefore, the cooling medium gas can be smoothly sucked into the cylinder, and the suction resistance of the cooling medium gas can be reduced effectively. As a result, the suction mass of the cooling medium gas per unit time (i.e., the cooling medium circulation amount) increases. This makes it possible to provide a highly efficient hermetic compressor.

Further, the above configuration eliminates the necessity of including a large-sized suction hole. Accordingly, the stress occurring in the circumferential direction to the portion of the suction reed, the portion being in contact with the suction hole, during the compression can be prevented from increasing. Therefore, the reliability of the suction reed can be improved, which makes it possible to provide a more reliable hermetic compressor.

Embodiment 2

In Embodiment 2, one example of a refrigeration apparatus including the hermetic compressor 10 described in Embodiment 1 is described in detail with reference to FIG. 10.

The hermetic compressor 10 according to the present invention can be widely and suitably used in various apparatuses (refrigeration apparatuses) that include a refrigeration cycle or that includes substantially the same elements as those of the refrigeration cycle. Specific examples of such apparatuses include refrigerators (household refrigerators, professional-use refrigerators), ice-making machines, showcases, dehumidifiers, heat-pump-type water heaters, heat-pump-type washing and drying machines, vending machines, air conditioners, and air compressors. These are non-limiting examples. In the present embodiment, a specific configuration of the refrigeration apparatus is described by taking a commodity storage apparatus 40 shown in FIG. 10 as one example of application of the hermetic compressor 10 according to the present invention.

Figure 10:
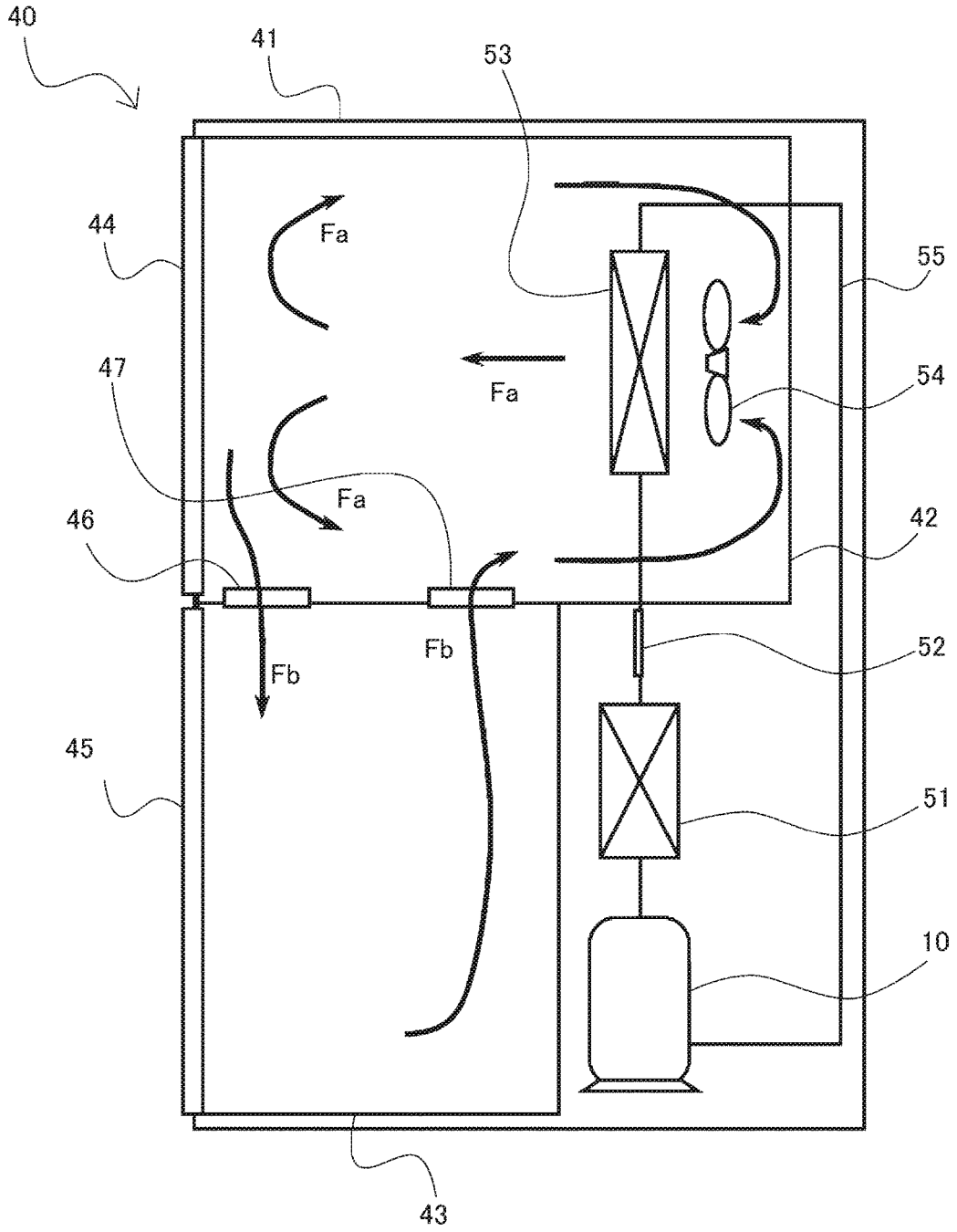
FIG. 10 is a schematic diagram showing a configuration example of a commodity storage apparatus, which is one example of a refrigeration apparatus including the hermetic compressor shown in FIG. 1.

The commodity storage apparatus 40 shown in FIG. 10 includes, for example, a storage apparatus body 41, a condenser 51, a decompressor 52, an evaporator 53, an air blower 54, piping 55, and the hermetic compressor 10. The condenser 51, the decompressor 52, the evaporator 53, and the hermetic compressor 10 are circularly-connected by the piping 55, thereby forming the refrigeration cycle. It should be noted that, in the present embodiment, R600a is used as a cooling medium gas.

A first storage compartment 42 and a second storage compartment 43 are provided in the front of the storage apparatus body 41, and the refrigeration cycle (including the condenser 51, the decompressor 52, the evaporator 53, the air blower 54, the hermetic compressor 10, and the piping 55) and the air blower 54 are provided in the rear of the storage apparatus body 41. The front of the first storage compartment 42 and the front of the second storage compartment 43 have respective openings. Other parts around the openings are covered by a heat insulating material. The front of the first storage compartment 42 is provided with a first door 44 corresponding to the opening, and the front of the second storage compartment 43 is provided with a second door 45 corresponding to the opening. Both the first door 44 and the second door 45 are heat-insulating doors, and are provided in such a manner that the openings can be opened and closed. The first storage compartment 42 and the second storage compartment 43 are in communication with each other via a front communication passage 46 and a rear communication passage 47.

In the rear of the storage apparatus body 41, the evaporator 53 is disposed inside the first storage compartment 42. In the first storage compartment 42, the air blower 54 is disposed behind the evaporator 53. When the refrigeration cycle operates, the evaporator 53 cools down the inside of the first storage compartment 42, and thereby cold air is generated. The air blower 54 causes the generated cold air to circulate in the first storage compartment 42 in a manner indicated by arrows Fa shown in FIG. 10. In addition, as previously described, the first storage compartment 42 and the second storage compartment 43 are in communication with each other via the front and rear communication passages 46 and 47. Accordingly, part of the cold air in the first storage compartment 42 also circulates in the second storage compartment 43 through the communication passages 46 and 47 in a manner indicated by arrows Fb shown in FIG. 10. As a result, the inside of the first storage compartment 42 and the second storage compartment 43 is cooled down.

In the present embodiment, the hermetic compressor 10 described in Embodiment 1 is used in the refrigeration cycle. Since the valve plate 30 of the hermetic compressor 10 can be readily manufactured, the hermetic compressor 10 can be manufactured with favorable productivity, and the hermetic compressor 10 is efficient and inexpensive. Since such a hermetic compressor 10 is installed in the commodity storage apparatus 40, the commodity storage apparatus 40 is capable of efficient cooling operation, consequently making it possible to effectively reduce the power consumption (amount).

Example

Hereinafter, a more specific description of the present invention is given based on Example and Comparative Example described below. However, the present invention is not limited by the description below. A person skilled in the art can make various changes, modifications, and alterations without departing from the scope of the present invention.

Example

The hermetic compressor 10 described in Embodiment 1 was incorporated in a refrigeration cycle in which R600a was sealed as a cooling medium gas. The hermetic compressor 10 was operated under the conditions of a condensation temperature of 25° C. to 60° C. and an evaporation temperature of −20° C. to −40° C. The relationship between the internal pressure (unit: kPa) of the cylinder 22 and the crank angle (unit: °) was examined. The results are shown in an upper graph of FIG. 12.

Comparative Example

Similar to the above Example, a conventional hermetic compressor (see FIG. 11) was incorporated in a refrigeration cycle in which R600a was sealed. The conventional hermetic compressor was operated under the same conditions as those used in the above Example, and the relationship between the internal pressure of the cylinder 22 and the crank angle was examined. The results are shown in a lower graph of FIG. 12.

(Comparison Between Example and Comparative Example)

Figure 12:
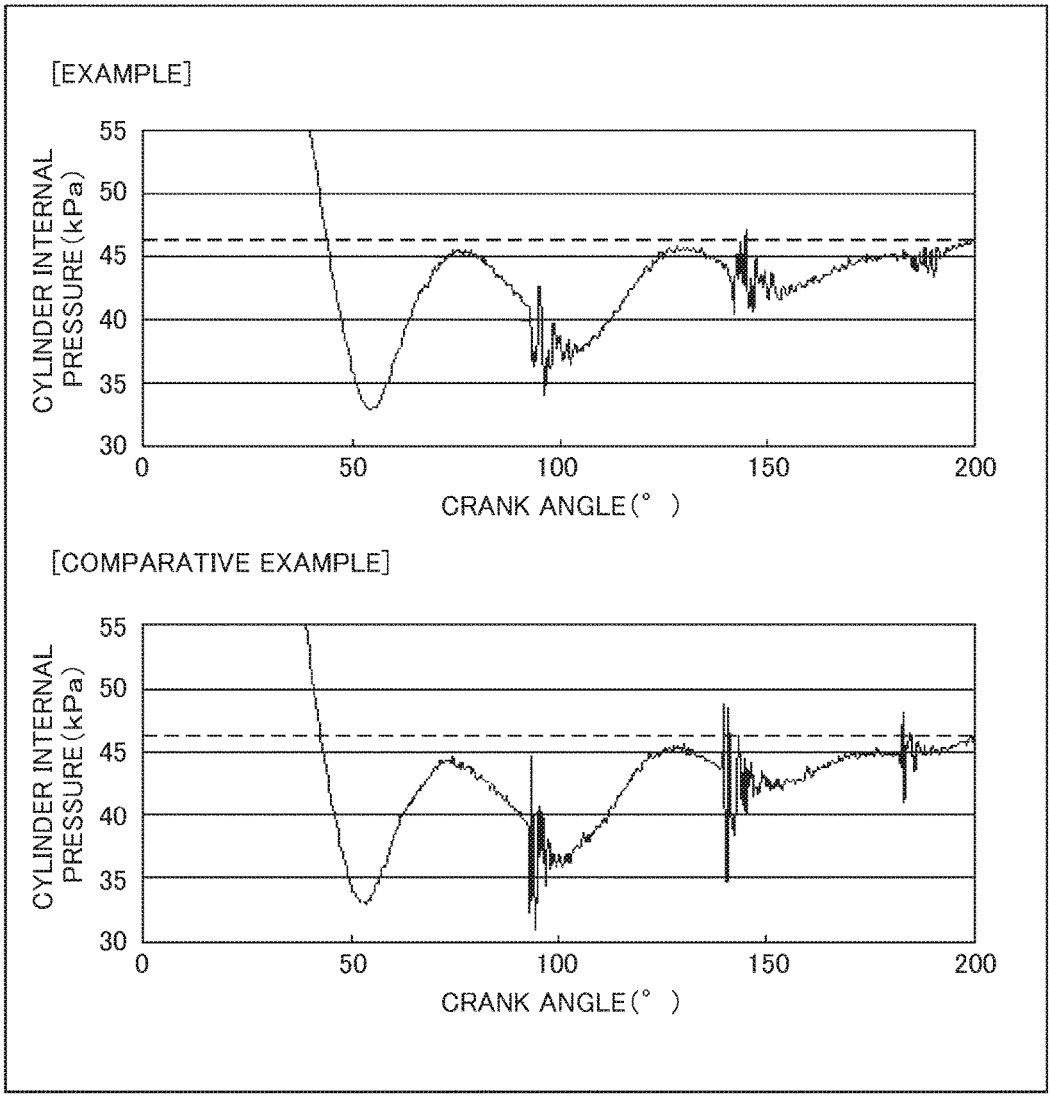
FIG. 12 illustrates graphs showing results of Example and Comparative Example of the present invention.

In the upper and lower graphs of FIG. 12, each dashed line represents a setting pressure of the lower-pressure side. The area of a region below the dashed line corresponds to the suction loss. In the case of the hermetic compressor 10 according to Example, i.e., the present invention, the area of the region below the dashed line is clearly less than in the case of the hermetic compressor according to Comparative Example, i.e., conventional art. Thus, according to the present invention, the suction loss can be reduced effectively.

From the foregoing description, numerous modifications and other embodiments of the present invention are obvious to one skilled in the art. Therefore, the foregoing description should be interpreted only as an example and is provided for the purpose of teaching the best mode for carrying out the present invention to one skilled in the art. The structural and/or functional details may be substantially altered without departing from the spirit of the present invention.

INDUSTRIAL APPLICABILITY

The present invention can be suitably used in the field of hermetic compressors. In addition, the present invention can be widely and suitably used in various apparatuses that include a refrigeration cycle using a hermetic compressor or that include substantially the same elements as those of the refrigeration cycle.

REFERENCE SIGNS LIST

10 hermetic compressor
11 sealed container
12 electric element
13 compression element
14 lubricating oil
22 cylinder
23 cylinder head
24 piston
26 suction muffler
27 suction reed
30 valve plate
33 suction hole
34 discharge hole
40 commodity storage apparatus (refrigeration apparatus)
51 condenser
52 decompressor
53 evaporator
54 air blower
262 communication pipe
263 communication pipe outlet
264 communication opening
**264*a*** upper shape
**264*b*** lower shape
265 end face of the communication pipe outlet
331 suction passage
332 suction inlet-side opening (opening at the communication pipe side)
333 suction outlet-side opening (opening at the cylinder side)
334 curved portion
335 sloped portion

The invention claimed is:

1. A hermetic compressor comprising:

a sealed container storing a lubricating oil;

an electric element housed in the sealed container; and a compression element housed in the sealed container and driven by the electric element to compress a cooling medium, wherein the compression element includes:

a cylinder, which forms a compression chamber;

a valve plate, which seals one end portion of the cylinder and in which a suction hole and a discharge hole are formed;

a suction reed configured to open and close the suction hole; and a suction muffler, which is positioned below the cylinder and in which a silencing space is formed, the suction muffler including a communication pipe connected to the suction hole, the communication pipe extends upward from the suction muffler toward the one end portion of the cylinder, and an upper end of the communication pipe is provided with a communication pipe outlet, which is in communication with the suction hole, the communication pipe outlet includes a communication opening, whose upper shape is a curved protruding shape and whose lower shape is a rectangular shape, an opening of the suction hole at the cylinder side has a non-recessed closed-curve shape, and an opening of the suction hole at the communication pipe side has a shape corresponding to that of the communication opening of the communication pipe outlet, such that an upper shape of the opening of the suction hole at the communication pipe side is a curved protruding shape, and a lower shape of the opening of the suction hole at the communication pipe side is a rectangular shape, a lower peripheral surface of the suction hole adjacent to the opening of the suction hole at the communication pipe side includes a curved portion and/or a sloped portion, and an upper peripheral surface of the suction hole adjacent to the opening of the suction hole at the communication pipe side is straight with no steps, an upper peripheral surface of the communication opening and the upper peripheral surface of the suction hole form one surface, such that there is substantially no step between these upper peripheral surfaces, and the valve plate and the communication pipe are connected in a state where the upper peripheral surface of the communication opening of the communication pipe outlet corresponds to the upper peripheral surface of the suction hole.

2. The hermetic compressor according to claim 1, wherein the curved portion of the lower peripheral surface of the suction hole is curved from the opening of the suction hole at the communication pipe side toward the opening of the suction hole at the cylinder side, and/or the sloped portion of the lower peripheral surface of the suction hole is sloped from the opening of the suction hole at the communication pipe side toward the opening of the suction hole at the cylinder side.

3. The hermetic compressor according to claim 1, wherein the suction hole is formed such that its cross-sectional area gradually decreases from the opening of the suction hole at the communication pipe side toward the opening of the suction hole at the cylinder side.

4. The hermetic compressor according to claim 1, wherein the opening of the suction hole at the cylinder side has a round shape or an elliptical shape, and an upper portion of the communication opening of the communication pipe outlet has a half-round shape or a semi-elliptical shape.

5. A refrigeration apparatus comprising a refrigeration cycle including the hermetic compressor according to claim 1.

6. The hermetic compressor according to claim 1, wherein the cross-sectional area of the opening of the suction hole at the communication pipe side is 150 to 250% of the cross-sectional area of the opening at the cylinder side.

* * * * *